US009714563B2

(12) United States Patent
Wilson et al.

(10) Patent No.: US 9,714,563 B2
(45) Date of Patent: Jul. 25, 2017

(54) DOWNHOLE TRIAXIAL ELECTROMAGNETIC RANGING

(71) Applicant: Halliburton Energy Services, Inc., Houston, TX (US)

(72) Inventors: Glenn A. Wilson, Houston, TX (US); Burkay Donderici, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 287 days.

(21) Appl. No.: 14/426,674

(22) PCT Filed: Dec. 5, 2013

(86) PCT No.: PCT/US2013/073425
§ 371 (c)(1),
(2) Date: Mar. 6, 2015

(87) PCT Pub. No.: WO2015/084379
PCT Pub. Date: Jun. 11, 2015

(65) Prior Publication Data

US 2016/0047224 A1 Feb. 18, 2016

(51) Int. Cl.

| | |
|---|---|
| ***E21B 47/022*** | (2012.01) |
| ***E21B 43/24*** | (2006.01) |
| ***E21B 47/09*** | (2012.01) |
| ***E21B 7/04*** | (2006.01) |
| ***E21B 47/024*** | (2006.01) |

(52) U.S. Cl.
CPC ..... *E21B 47/02216* (2013.01); *E21B 7/04* (2013.01); *E21B 43/2406* (2013.01); *E21B 47/024* (2013.01); *E21B 47/0905* (2013.01)

(58) Field of Classification Search
CPC .... E21B 47/022; E21B 47/02216; E21B 7/04; E21B 43/2406; E21B 47/024; E21B 47/0905
See application file for complete search history.

(56) References Cited

U.S. PATENT DOCUMENTS 4,072,200 A * 2/1978 Morris ..... E21B 7/04 175/45
4,328,548 A * 5/1982 Crow ..... G01S 3/14 342/451

(Continued)

OTHER PUBLICATIONS

International Search Report and the Written Opinion of the International Searching Authority, or the Declaration, Apr. 18, 2014, PCT/US13/73425, 13 pages, International Searching Authority, US.

(Continued)

*Primary Examiner* — Yong-Suk (Philip) Ro
(74) *Attorney, Agent, or Firm* — Haynes and Boone, LLP

(57) ABSTRACT

A ranging system calculates the distance, direction and orientation of a target well through rotationally invariant analysis of triaxial electric and magnetic field measurements from a bottom hole assembly ("BHA") having electromagnetic sensors. The triaxial electric and magnetic field sensors can be deployed in any downhole device without explicitly needing to process or retrieve rotational information about the downhole BHA or wireline device. Also, the distance, direction and orientation of the target well can be retrieved from a single measurement position.

30 Claims, 5 Drawing Sheets

(56) References Cited

U.S. PATENT DOCUMENTS 5,218,301 A * 6/1993 Kuckes ..... E21B 47/02 324/207.26
5,582,248 A * 12/1996 Estes ..... E21B 43/119 166/255.2
7,141,968 B2 11/2006 Hibbs et al.
7,141,987 B2 11/2006 Hibbs et al.
7,170,294 B2 * 1/2007 Kasevich ..... E21B 43/24 324/333
7,400,976 B2 7/2008 Young et al.
7,440,858 B2 * 10/2008 Simons ..... G01R 29/0892 702/66
7,565,245 B2 * 7/2009 Andreis ..... G01V 3/12 702/7
7,656,161 B2 * 2/2010 McElhinney ..... E21B 47/02216 324/346
7,991,570 B2 8/2011 Carrigan
2008/0041626 A1 * 2/2008 Clark ..... E21B 47/02216 175/45
2009/0095530 A1 4/2009 Waters et al.
2009/0308657 A1 * 12/2009 Clark ..... E21B 47/02216 175/45
2012/0139530 A1 * 6/2012 McElhinney ..... E21B 47/02216 324/207.13
2012/0283951 A1 11/2012 Li et al.
2013/0056272 A1 3/2013 Kuckes

OTHER PUBLICATIONS

Ward et al., Electromagnetic Theory for Geophysical Applications, Electromagnetic Methods in Applied Geophysics, 1987, pp. 178-181, vol. 1, No. 3.
Jackson, J. D., Poynting's Theorem for Harmonic Fields; Field Definitions of Impedance and Admittance, Classical Electrodynamics, 1999, pp. 264-267, Third Edition.

* cited by examiner

DOWNHOLE TRIAXIAL ELECTROMAGNETIC RANGING

The present application is a U.S. National Stage patent application of International Patent Application No. PCT/US2013/073425, filed on Dec. 5, 2013, the benefit of which is claimed and the disclosure of which is incorporated herein by reference in its entirety.

FIELD OF THE DISCLOSURE

The present disclosure relates generally to downhole ranging and, more specifically, to a ranging assembly utilizing triaxial electric and magnetic field measurements to determine and track the relative location of multiple wellbores.

BACKGROUND

Determining the position and direction of a conductive pipe (metallic casing, for example) accurately and efficiently is required in a variety of downhole applications. Perhaps the most important of these applications is the case of a blown out well in which the target well must be intersected very precisely by a relief well in order to stop the blowout. Other important applications include drilling of a well parallel to an existing well in Steam Assisted Gravity Drainage ("SAGD") systems, avoiding collisions with other wells in a crowded oil field where wells are drilled in close proximity to each other and tracking an underground drilling path using a current injected metallic pipe over the ground as a reference. In SAGD is applications, a common practice is to use wireline systems for electromagnetic ranging between the wells. However, this requires access to both wells which is both time-consuming, and expensive. An alternative practice is to use electromagnetic logging-while-drilling systems, as these only require access to a single well.

However, the aforementioned approaches may only measure and process magnetic fields using inductive sensors. While this has served as a practical solution in the past, this could limit the operation to low frequencies and may not utilize all available electromagnetic information. Recently, other methods related to magnetic field gradient measurements have been disclosed, but these latter methods require the emplacement of multiple, proximal inductive sensors to approximate the magnetic field gradients, rather than measure the magnetic field gradients directly.

Accordingly, there is a need in the art for improved and/or alternative downhole ranging techniques.

DESCRIPTION OF ILLUSTRATIVE EMBODIMENTS

Figure 1A:
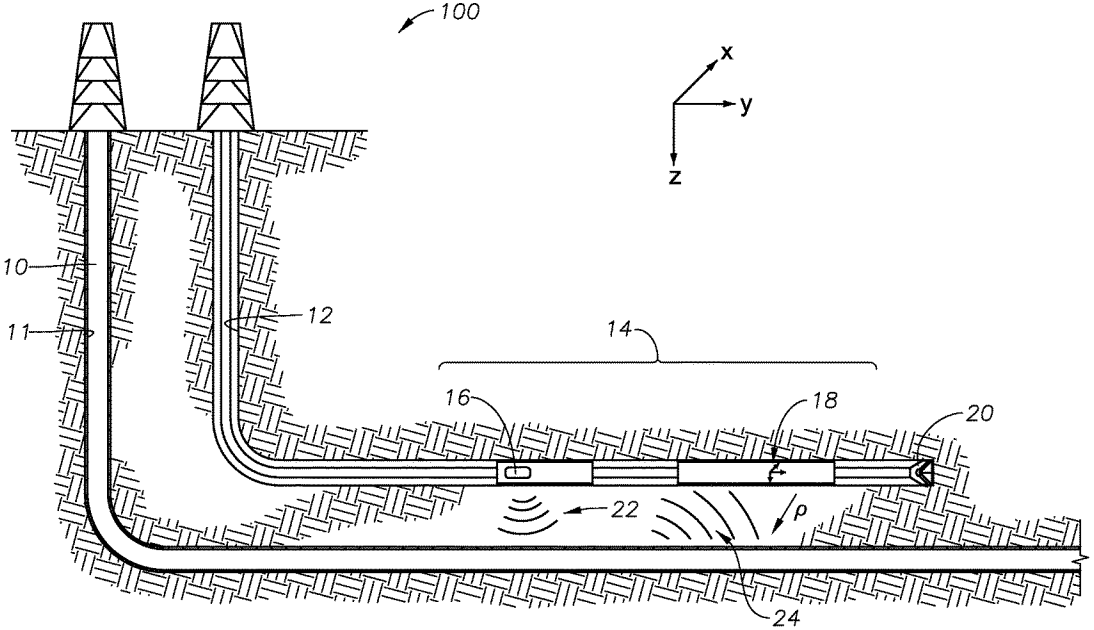
FIG. 1A illustrates a relative positioning system according to certain illustrative embodiments of the present disclosure.

Illustrative embodiments and related methodologies of the present disclosure are described below as they might be employed in ranging systems and methods utilizing triaxial electric and magnetic field measurements to drill and/or track the relative location of wellbores. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As described herein, illustrative embodiments and methods of the present disclosure describe ranging systems that utilize triaxial electric and magnetic field measurements to retrieve the Poynting vector, which is the measure of the directional energy flux density of an electromagnetic field. In general, the target well is cased and excited by a time varying current source. In one embodiment of the disclosure, the target well is excited by a time varying current source at the target well head. In another embodiment of the disclosure, the target well is excited by a time varying current source on the surface. In yet another embodiment, the target well is excited by a time varying current source disposed in the monitoring well.

Once measured, utilizing various algorithms described herein, processing circuitry located on the bottom hole assembly ("BHA") (and/or at least partially at a remote location such as on the surface, further up the borehole, or at a facility remote from the well site) analyzes the triaxial measurement data to determine the distance and direction to the target casing. It is noted here that the teachings that are disclosed here are also valid for any elongated conductive body other than a casing. In one embodiment, the direction of the Poynting Vector will provide the direction to the target well. In another embodiment, the gradient of the measured Poynting Vector will provide the distance of the target well. In yet another embodiment, the imaginary component of the measured impedance will provide the distance of the target well. In another, analysis of both the distance and direction of the Poynting Vector will provide the orientation of the target well. In yet another embodiment, analysis of the electric fields will provide the orientation of the target well.

Moreover, as will be described herein, the Poynting Vector, impedance, and electric fields are rotationally invariant to the orientation of the triaxial electric and magnetic field sensors in the measurement well. Accordingly, in certain embodiments, the sensors can be rotating as part of the BHA or wireline device, and yet recover the same values of the Poynting Vector, impedance, and electric fields.

Although the present disclosure may be utilized in a variety of applications, the following description will focus on applications for accurately, and reliably positioning a well is being drilled, the monitoring or "injector" well (i.e., second well), with respect to a nearby target first well, usually the producer well, so that the injector well can be maintained approximately parallel to the producer well. The target well must be of a higher conductivity than the surrounding formation, which may be realized through the use of an elongated conductive body along the target well, such as, for example, casing which is already present in most wells to preserve the integrity of the well. Also, the method and system of the disclosure are particularly desirable for the drilling of SAGD wells because the two wells can be drilled close to one another as is required in SAGD operations. These and other applications and/or adaptations will be understood by those ordinarily skilled in the art having the benefit of this disclosure.

FIG. 1A illustrates a relative positioning system 100 according to an exemplary embodiment of the present disclosure. In this embodiment, a producer well 10 is drilled using any suitable drilling technique. Thereafter, producer well 10 is cased with casing 11. An injector well 12 is then drilled using BHA 14 which may be, for example, a logging-while drilling ("LWD") assembly, measurement-while drilling assembly ("MWD") or other desired drilling assembly. Although injector well 12 is described as being subsequently drilled, in other embodiments producer well 10 and injector well 12 may be drilled simultaneously. Moreover, in yet another alternate embodiment, BHA 14 may be embodied as a wireline application (without a drilling assembly) performing logging operations, as will be understood by those same ordinarily skilled persons mentioned herein.

Figure 1D:
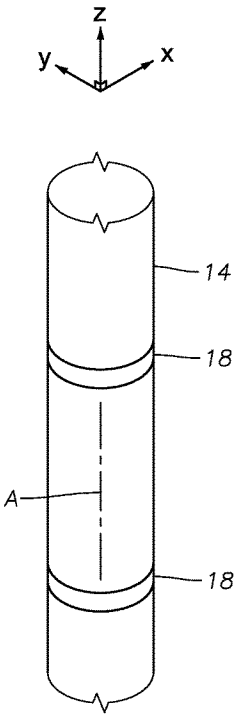
FIG. 1D illustrates axially separated electric field sensors positioned along the drilling assembly, according to certain illustrative embodiments of the present disclosure.
Figure 1C:
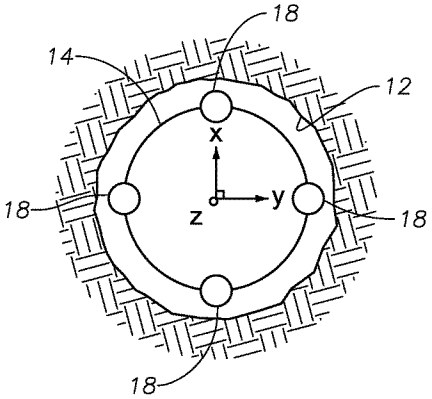
FIG. 1C is a cross-sectional view of an electric field sensor orientation of the drilling assembly, according to certain illustrative embodiments of the present disclosure.
Figure 1B:
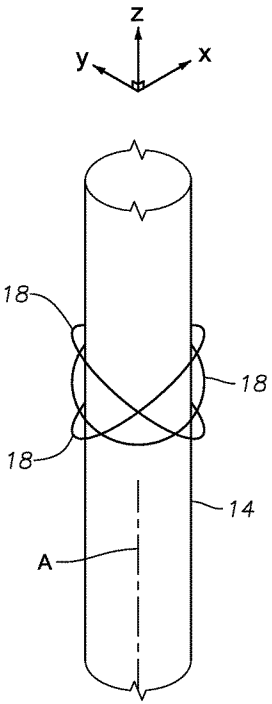
FIG. 1B illustrates three collocated, orthogonal triaxial magnetic field sensors positioned along a drilling assembly utilized in a relative positioning system, according to certain illustrative embodiments of the present disclosure.

In this exemplary embodiment, the BHA/drilling assembly 14 includes one or more electromagnetic field transmitters 16. Such a transmitter may be, for example, a coil, tilted coil, or combinations of electrodes, or other controlled electromagnetic field source. Drilling assembly 14 also includes one or more triaxial electric and/or magnetic field sensors 18 positioned above drill bit 20. As understood in the art, the sensors used to measure electric and magnetic fields are different; however, such sensors may be described herein separately as electric and magnetic field sensors or jointly as electromagnetic field sensors. Such sensors may include, for example, combinations of electrodes, coils, tilted coils, magnetometers, or magnetorestrictive sensors. The particular arrangement of sensors 18 along drilling assembly 14 may take a variety of forms. FIGS. 1B-1D illustrate a variety of alternative arrangements for sensors 18. In one illustrative embodiment, the electric and magnetic fields are measured is along the x,y,z axes (i.e., triaxial) using three collocated electric and magnetic field sensors 18. Such an embodiment is illustrated in FIG. 1B, which illustrates three collocated, orthogonal triaxial magnetic field sensors (e.g., coils) positioned along drilling assembly 14 which are oriented at an angle of 45 degrees relative to the axis A of drilling assembly 14.

In yet other illustrative embodiments, the radial electric fields can be measured using at least four electrodes at uniform angles about the mandrel circumference. For example, four electrode may be used as sensors 18, and are radially positioned around the mandrel circumference of drilling assembly 14 at angles of 90 degrees, as shown in FIG. 1C which illustrates a cross-sectional view of drilling assembly 14 extending along second wellbore 12. In yet another embodiment (not shown), eight electrodes are located at angles of 45 degrees about the mandrel circumference. In yet another alternate embodiment as shown in FIG. 1D, the axial electric fields can be measured on drilling assembly 14 using at least two electrodes sensors 18 axially separated about axis A of the mandrel. In some embodiments, the electrodes are directly exposed to the drilling fluids and formation, and operate via galvanic coupling. In other embodiments, the electrodes are not directly exposed to the drilling fluids and formation, and operate via capacitive coupling. In certain other embodiments, regardless of the sensor design utilized, the centers of each sensor are collocated. These and other sensor designs may be utilized with the present disclosure, as will be understood by those ordinarily skilled in the art having the benefit of this disclosure.

Referring back to FIG. 1A, during an exemplary drilling operation using relative positioning system 100, drilling assembly 14 is deployed downhole to drill injector well 12 after, or contemporaneously with, the drilling of producer well 10. In order to maintain injector well 12 at the desired distance and direction from producer well 10, relative positioning system 100 activates transmitter 16 to propagate electromagnetic fields 22 to thereby induce a current along target casing 11 of producer well 10. As a result, electromagnetic fields 24 radiate from target casing 11, where the triaxial electric and magnetic fields are measured by sensors 18. Local or remote processing circuitry then utilizes the triaxial electromagnetic field measurements to determine the distance or direction to producer well 10, in addition to the orientation of producer well 10. Once the relative position is determined, the circuitry generates signals necessary to steer the drilling assembly 14 in the direction needed to maintain the desired distance and direction from producer well 10.

Although not shown, note that in alternate embodiments the current along casing 11 may be excited by a time varying current source at the target well head. In another embodiment of the disclosure, the target well is excited by a current source on the surface. Furthermore, although not shown as well, drilling assembly 14 includes processing circuitry necessary (i.e., system control center) to achieve the relative positioning of the present disclosure in real-time. Such circuitry includes a communications unit to facilitate interaction between drilling system 14 and a remote location (such as the surface). A visualization unit may also be connected to communications unit to monitor the measurement data being process; for example, an operator may intervene the system operations based on this data. A data processing unit may convert the received data into information giving the target's position, direction and orientation in real-time. Thereafter, results may be displayed via the visualizing unit.

The system control center of drilling assembly 14 also includes the storage/communication circuitry necessary to perform the calculations described herein. In certain embodiments, that circuitry is communicably coupled to transmitters 16 utilized to generate electromagnetic fields 22, and also likewise coupled to sensors 18 in order to process the received electric and magnetic fields forming the electromagnetic field 24. Additionally, the circuitry on-board drilling assembly 14 may be communicably coupled via wired or wireless connections to the surface to thereby communicate data back uphole and/or to other assembly components (to steer a drill bit forming part of assembly 14, for example). In an alternate embodiment, the system control center or other circuitry necessary to perform one or more aspects of the techniques described herein may be located at a remote location away from drilling assembly 14, such as the surface or in a different wellbore. For example, in certain embodiments, the transmitter may be located in another well or at the surface. In other embodiments, the electromagnetic field measurements may be communicated remotely to the system control center for processing. These and other variations will be readily apparent to those ordinarily skilled in the art having the benefit of this disclosure.

Moreover, the on-board circuitry includes at least one processor and a non-transitory and computer-readable storage, all interconnected via a system bus. Software instructions executable by the system control center for implementing the illustrative relative positioning methodologies described herein in may be stored in local storage or some other computer-readable medium. It will also be recognized that the positioning software instructions may also be loaded into the storage from a CD-ROM or other appropriate storage media via wired or wireless methods.

Moreover, those ordinarily skilled in the art will appreciate that various aspects of the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof in a computer system or other processing system.

Now that a generalized illustrative embodiment of the present disclosure has been described, the methodology by which relative positioning is determined will now be described. As previously mentioned, embodiments of the present disclosure utilize both electric and magnetic field measurements for electromagnetic ranging. Illustrative embodiments may be exemplified in the following theoretical example, which is not intended to limit the scope of disclosure. With reference to FIG. 1A, target well 10 may be defined by the triaxial coordinate system r={x, y, z} and can be approximated by an infinitely long current source oriented in the z direction in a homogeneous geological formation of conductivity σ such that the electric current along casing 11 can be approximated as:

$$J(r)=I\delta(r)\delta(z)\hat{u}_z,$$

$$J(r)=I\delta(r)\delta(z)\hat{u}_z, \quad \text{Eq. (1).}$$

Here, J(r) is the current density, I is the current, δ(r) and δ(z) are delta functions, and $\hat{u}_z$ is a unit vector directed along the axis of the current source. Given the radial symmetry about target well 10, electromagnetic fields 24 can be described in cylindrical coordinates r=(z, ρ, θ) about the z-axis. Note that the cylindrical coordinates r=(z, ρ, θ) can be transformed to Cartesian coordinates r=(x,y,z), and vice versa. Of particular interest to electromagnetic ranging is the distance to target well 10, $\rho=\sqrt{(x^2+y^2)}$ (note that √ denotes the square root), and the direction (angle) to target well 10, θ. The orientation of target well 10 relative to drilling assembly 14 can be also be retrieved.

As will be understood by those ordinarily skilled in the art having the benefit of this disclosure, the electric field at an angular frequency ω about target well 10 only has a z-directed axial component:

$$E_z(r,\omega)=((i\omega\mu I)/(2\pi))K_0(ik\rho)\hat{u}_z,\ E_z(r,\omega)=\frac{i\omega\mu I}{2\pi}K_0(ik\rho)\hat{u}_z, \quad \text{Eq. (2)}$$

Where $k=\sqrt{(i\omega\mu\sigma)}$ is the wavenumber, ρ is the radial distance between the two wells in the xyxy-plane, and $K_0$ is the modified Bessel function of the second kind of order zero. It is also noted here that in a case where target well 10 is aligned with the axial direction of drilling assembly 10, the z-directed axial component of the electric field can be measured by placing two axially separated sensors/receivers 18 (e.g., electrodes) along drilling assembly 14.

Therefore, it follows that the magnetic field at an angular frequency ω about target well 10 has a θ-directed tangential component:

$$H_\theta(r,\omega)=((ikI)/(2\pi))K_1(ik\rho)\hat{u}_\theta, \quad \text{Eq. (3),}$$

where $K_1$ is the modified Bessel function of the second kind of order one, and $\hat{u}_\theta$ is a unit vector in the azimuthal direction about the axis of the current source. At low frequencies used for and small distances typically encountered in electromagnetic ranging, the modified Bessel functions in Equations (2) and (3) can be approximated by:

$$K_0(ik\rho)\approx -ln(ik\rho) \quad \text{Eq. (4), and}$$

$$K_1(ik\rho)\approx -1/(ik\rho') \quad \text{Eq. (5)}$$

such that the electric field (Eq. 2) and magnetic field (Eq. 3) at an angular frequency ω are respectively expressed as:

$$E_z(r,\omega)=-((i\omega\mu I)/(2\pi))ln(ik\rho)\hat{u}_z \quad \text{Eq. (6), and}$$

$$H_\theta(r,\omega)=-I/(2\pi\rho)\hat{u}_\theta \quad \text{Eq. (7).}$$

Originating from conservation of energy considerations, the Poynting Theorem generally states that for any electromagnetic field, there must be electromagnetic energy flowing in the medium due to the electromagnetic fields. The Poynting Vector, S, which is the measure of the directional energy flux density of an electromagnetic field, can be derived from the cross product of the electric E and magnetic H field vectors. For linear dispersive media with losses, which is typical for earth materials, the Poynting Vector is defined in the frequency domain as:

$$S=0.5E\times H^*=0.5(E_yH^*_z-E_zH^*_y)\hat{u}_z+0.5(E_zH^*_x-E_xH^*_z)\hat{u}_y+0.5(E_xH^*_y-E_yH^*_x)\hat{u}_z \quad \text{Eq. (8)},$$

where * denotes the complex conjugate, and $\hat{u}_x$, $\hat{u}_y$, and $\hat{u}_z$ are unit vectors in x-, y-, and z-directed unit vectors in Cartesian coordinates relative to the axis of the current source. In cylindrical coordinates, the Poynting Vector (Eq. 8) is express as:

$$S=0.5E\times H^*=0.5(E_\theta H^*_z-E_zH^*_\theta)\hat{u}_r+0.5(E_rH^*_z-E_zH^*_r)\hat{u}_\theta+0.5(E_rH^*_\theta-E_\theta H^*_r)\hat{u}_z \quad \text{Eq. (9)},$$

where $\hat{u}_r$, $\hat{u}_\theta\hat{u}_\theta$, and $\hat{u}_z$ are radial-, azimuthal-, and axial-directed unit vectors in cylindrical coordinates relative to the axis of the current source. From Equations 6 and 7 above, Equation 9 may be reduced to:

$$S=0.5E\times H^*=(-0.5E_zH^*_\theta)\hat{u}_r=-((i\omega\mu I^2)/(4\pi^2\rho))ln(ik\rho)\hat{u}_r \quad \text{Eq. (10)}.$$

Figure 2:
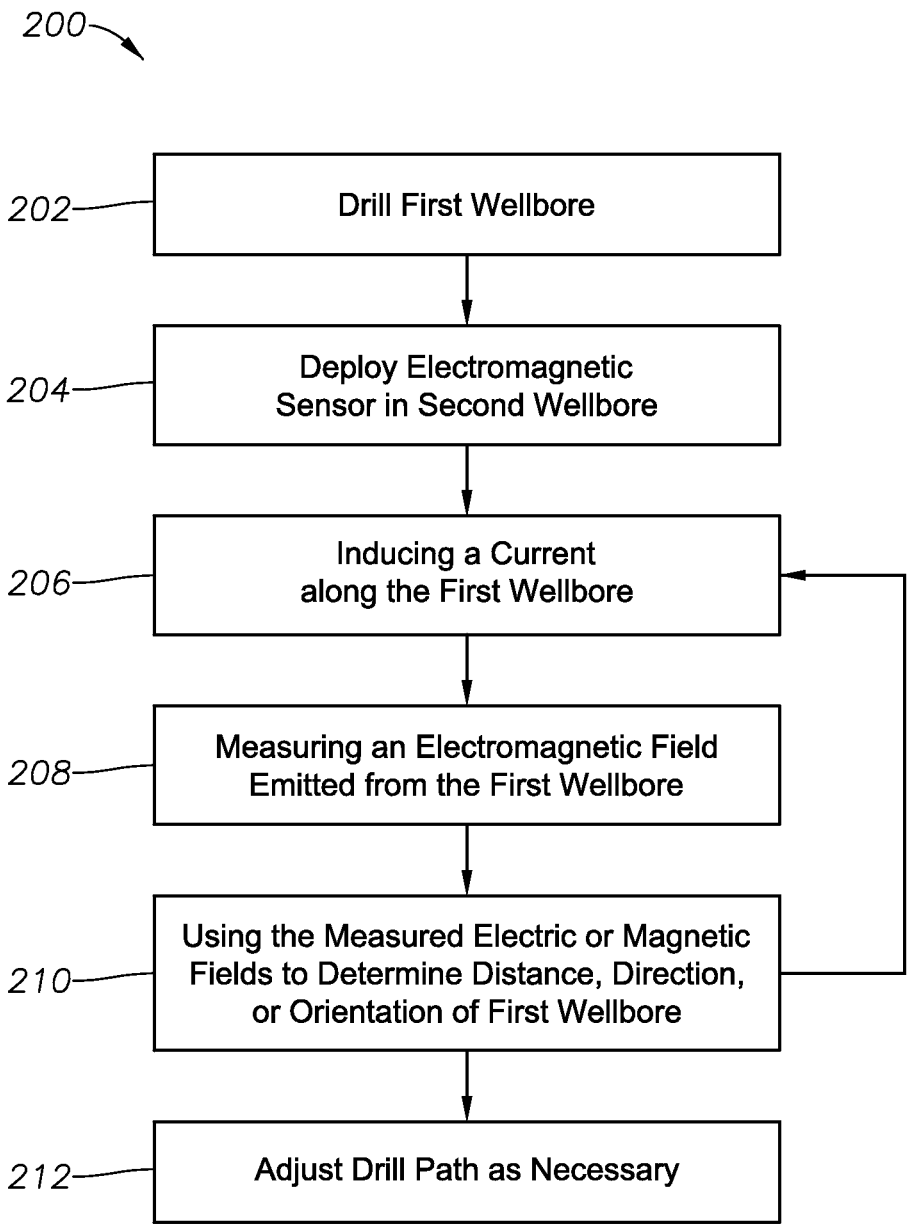
FIG. 2 is a flow chart showing a generalized ranging method used to calculate the distance between a first target well and a second well, the direction to the first target well, or the orientation of the first target well, according to certain illustrative methods of the present disclosure.

In the illustrative embodiments of the present disclosure, the system control center utilizes the method described above to achieve the relative positioning calculations described herein. FIG. 2 is a flow chart showing a generalized ranging method 200 used to calculate the distance between a first target well and a second well, the direction to the first target well, or the orientation of the first target well, according to certain illustrative methods of the present disclosure. Again, the specific application may be, for example, a SAGD application. With reference to FIGS. 1 and 2, at block 202, a first wellbore 10 is drilled using any suitable methodology. First wellbore 10 has a higher conductivity than the surrounding formation which, for example, may be achieved using casing 11 of first wellbore 10 or through utilization of some other elongated conductive body positioned along first wellbore 10.

At block 204, one or more electric and/or magnetic sensors 18 are deployed into a second wellbore 12. In certain embodiments, there may be two sensors that are radially separated along the axis of second wellbore 12. Sensors 18 may be deployed in second wellbore 12 in a variety of ways including, for example, along drilling assembly 14 utilized in a SAGD operation or a subsea operation. Note that in alternative methodologies, the first and second wellbores 10,12 may be drilled contemporaneously.

At block 206, a current is induced along first wellbore 10 which results in an electromagnetic field 24 being emitted from first wellbore 10. In general, the current is induced using a time varying current source that may be generated in a variety of ways. In one embodiment of the disclosure, the current is induced along casing 11 by a time varying current source at the well head of first wellbore 10. In another embodiment of the disclosure, the current is induced along casing 11 by a time varying current source on the surface. In yet another embodiment as shown in FIG. 1, the current is induced along casing 11 by an electromagnetic transmitter 16 positioned along drilling assembly 14 in second well 12.

At block 208, the electromagnetic field 24 is then received by sensor(s) 18. As will be described in more detail below, at block 210, via the system control center, the relative positioning system 100 utilizes the measured triaxial electric or magnetic fields to calculate, in real-time, the distance between the first and second wellbores, the direction to the first wellbore relative to the second wellbore, or the orientation of the first wellbore. After analyzing the measured triaxial electromagnetic fields, relative positioning system 100 determines what actions, if any, are necessary to maintain or correct the desired drilling path at block 212. Such actions may be, for example, a change in direction, speed, weight on bit, etc., to thereby steer the BHA as desired. Simultaneously, the algorithm returns to block 206 where it continues to excite the transmitters to continuously monitor and/or adjust the drill path as necessary.

Figure 3A:
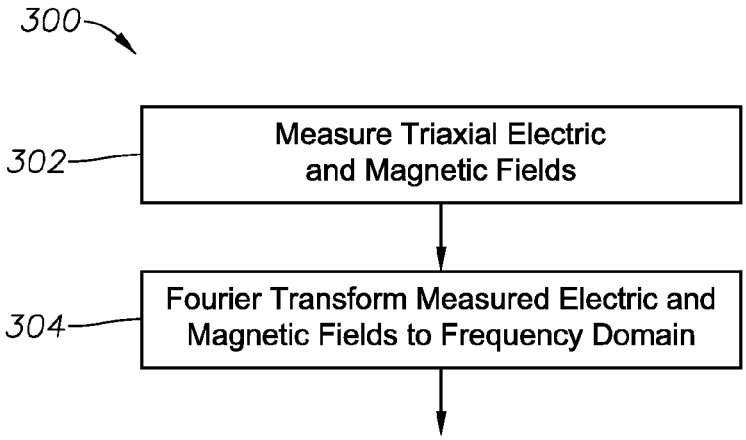
FIG. 3A is a flow chart of a method utilized to calculate direction, distance and orientation of a target well using triaxial electric and magnetic field measurements, according to certain illustrate methods of the present disclosure.

FIG. 3A is a flow chart of a method 300 utilized to calculate direction, distance and orientation of a target well using triaxial electric and magnetic field measurements, according to certain illustrate methods of the present disclosure. After current has been induced along the casing, the emitted electromagnetic field 24 (FIG. 1A) is sensed by sensors 18 as previously described. At block 302, the transient triaxial electric and magnetic fields are measured by sensors 18. At block 304, the system control center of the relative positioning system then transforms (e.g., using Fourier transform) the measured electric and magnetic fields into their respective frequency-domain electric and magnetic fields, as defined by Equations 6 and 7 described above. The system control center may then utilize the frequency-domain electric and magnetic fields in a variety of algorithms to conduct ranging, as described in the illustrate flow charts of FIGS. 3B-3F.

Figure 3B:
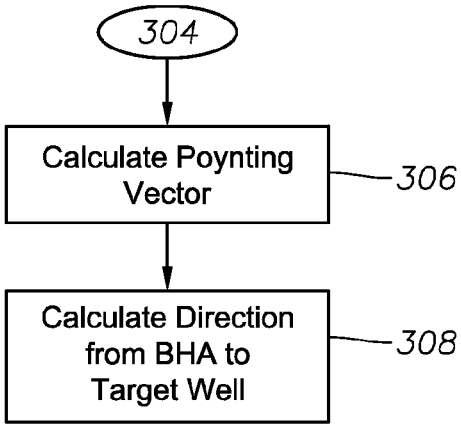
FIG. 3B is a flow chart showing how the direction from a bottom hole assembly to a target well can be determined using the Poynting Vector, according to certain illustrative methods of the present disclosure.

FIG. 3B is a flow chart showing how the direction from a BHA to a target well can be determined using the Poynting Vector, according to certain illustrative methods of the present disclosure. At block 306, the system control center first calculates the Poynting Vector using Equations 8-10. It can be observed that S in Equation 10 is always directed along $\hat{u}_r$ towards the target well. Thus, by evaluating the Poynting Vector from triaxial electric and magnetic field measurements, the system control center determines the direction to the target well at block 308. The magnetic field is actually recovered from magnetic induction measurements. It follows that the magnitude of Equation 10 is scaled by the magnetic permeability, but the direction of the Poynting Vector remains unchanged. While Equation 10 demonstrates it is possible to recover the direction to the target well from the Poynting Vector, Equation 10 also demonstrates that it is not straightforward to recover the distance to the target well from the Poynting Vector, as the magnitude of Equation 10 is a nonlinear function with respect to the range p, and is dependent upon the current, wavenumber, and permeability of the medium; all of which may be unknown.

Figure 3C:
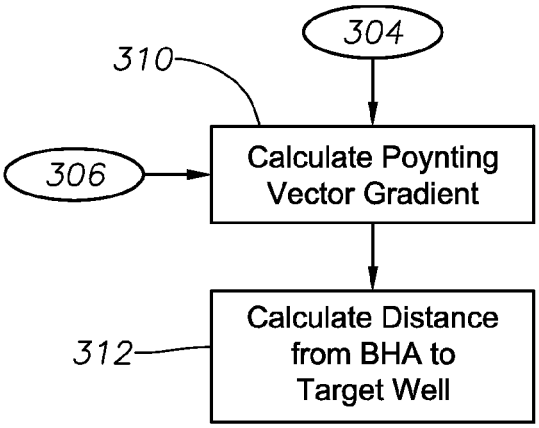
FIG. 3C is a flow chart showing how the distance from a bottom hole assembly to a target well can be determined using the ratio of the Poynting Vector to the gradient of the Poynting Vector, according to certain illustrative methods of the present disclosure.

FIG. 3C is a flow chart showing how the distance from a BHA to a target well can be determined using the ratio of the Poynting Vector to the gradient of the Poynting Vector, according to certain illustrative methods of the present disclosure. Using the data from blocks 304 and 306, the system control center calculates the Poynting Vector gradient at block 310. Here, the system control center calculates the gradient of the Poynting Vector $\partial S/\partial\rho$ using:

$$\partial S/\partial\rho\approx((i\omega\mu I^2)/(4\pi^2\rho^2))(1-\ln(ik\rho))\hat{u}_r, \quad \text{Eq. (11)},$$

where the variables were defined previously. The ratio of the Poynting Vector to the gradient of the Poynting Vector can then be calculated using:

$$\rho(1/((1-\ln(ik\rho))-1)=|S|/(|\partial S/\partial\rho|), \quad \text{Eq. (12)},$$

which, for $|ik\rho|<<1$, can be reduced to:

$$\rho\approx-|S|/(|\partial S/\partial\rho|), \quad \text{Eq. (13)}.$$

As a result, at block 312, the system control center calculates the distance from the BHA to the target well using the absolute value and gradient of the Poynting Vector. More specifically, the system control center utilizes the spatial finite difference for the gradient, the same way it is traditionally done for the magnetic field. The gradient measurement of the Poynting Vector requires multiple electric field measurements, in addition to the multiple magnetic field measurements that are traditionally used.

Figure 3D:
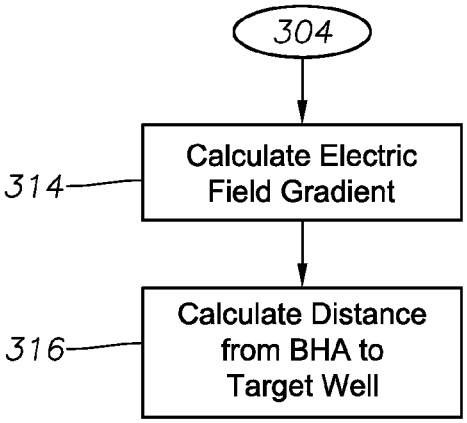
FIG. 3D is a flow chart showing how the distance from a bottom hole assembly to a target well can be determined using the gradient of the measured electric field, according to certain illustrative methods of the present disclosure.

FIG. 3D is a flow chart showing how the distance from a BHA to a target well can be determined using the gradient of the measured electric field, according to certain illustrative methods of the present disclosure. Using the data received from block 304, the system control center calculates the gradient of the measured electric field at block 314. By measuring the electric field using:

$$E_z(r,\omega)=((i\omega\mu I)/(2\pi))ln(ik\rho)\hat{u}_z, \quad \text{Eq. (14)}$$

and it's gradient with respect to the radial distance:

$$(\partial E_z(r,\omega))/(\partial\rho)=-((i\omega\mu I)/(2\pi))(1/\rho)\hat{u}_z, \quad \text{Eq. (15)},$$

then the ratio of the measured electric field to the gradient of the measured electric field with respect to radial distance is:

$$\ln(ik\rho)\rho=|E_z|/(|\partial E_z/\partial\rho|), \quad \text{Eq. (16)}.$$

Using L'Hopital's rule as ikp→0, it follows that:

$$(1/\rho)/(-1/\rho^2)=|E_z|/(|\partial E_z/\partial\rho|), \quad \text{Eq. (17)},$$

which simplifies as:

$$\rho=-|E_z|/(|\partial E_z/\partial\rho|), \quad \text{Eq. (18)}.$$

As a result of Equation 18, at block 316, the distance can be calculated from the absolute value and gradient of the electric field vector by utilizing the finite difference in space for the gradient, the same way it is traditionally done for the magnetic fields. Gradient measurements of the electric fields require multiple electric field measurements, instead of the multiple magnetic field measurements that are traditionally used.

Figure 3E:
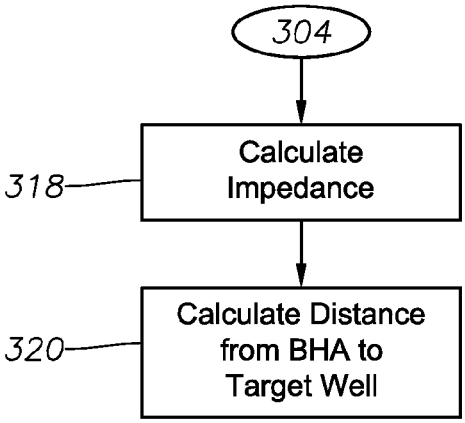
FIG. 3E is a flow chart showing how the distance from a bottom hole assembly to a target well can be determined using the impedance of the measured electric and magnetic fields, according to certain illustrative methods of the present disclosure.

FIG. 3E is a flow chart showing how the distance from a BHA to a target well can be determined using the impedance of the measured electric and magnetic fields, according to certain illustrative methods of the present disclosure. To calculate the distance in this illustrative method, the system control center calculates the impedance at block 318 using the impedance transfer function Z(r,ω):

$$Z(r,\omega)=(E_z(r,\omega))/(H_\theta(r,\omega))=-i\omega\mu I\rho\ \ln(ik\rho) \quad \text{Eq. (19)},$$

where the variables were defined previously. Using L'Hopital's rule as ikp→0, it follows that:

$$\omega\mu((1/\rho)/(-1/\rho^2)=(E_z(r,\omega))/H_\theta(r,\omega)), \quad \text{Eq. (20)},$$

which reduces to:

$$\rho=(1/\omega\mu)Im[(E_z(r,\omega))/H_\theta(r,\omega))], \quad \text{Eq. (21)},$$

where Im represents the imaginary component of the impedance at a radial frequency, scaled by a product of the angular frequency and magnetic permeability. As a result, at block 320, the system control center calculates the distance from a combination of electric and magnetic field measurements and also two parameters; frequency and magnetic permeability. For most formations, the magnetic permeability can be assumed to be that of free space (i.e., non-magnetic). In this illustrative method, the magnetic field is actually recovered from magnetic induction measurements, and it follows that Equation 21 can be expressed as:

$$\rho=(1/\omega)Im[(E_z(r,\omega))/B_\theta(r,\omega))], \quad \text{Eq. (22)},$$

which illustrates that the system control center may calculate the distance using a combination of the measured electric field and magnetic induction measurements, as well as the angular frequency.

The orientation independent of the triaxial measurements described herein should also be noted. As previously mentioned, the triaxial electric and magnetic fields are measured by sensors attached to a BHA, and are defined by the Cartesian coordinate system r'={x', y', z'}, which is related to the Cartesian coordinate system of the target well r={x, y, z} through the three (generally unknown) Euler angles α, β, θ:

$$r'=R(\alpha,\beta,\phi)r \quad \text{Eq. (23)},$$

where R(α, β, ϕ) is the Euler rotation matrix. The rotational invariance of the cross product states that:

$$S(r',\omega)=R(\alpha,\beta,\phi)S(r,\omega)=0.5E(r',\omega)\times H^*(r',\omega)=0.5R(\alpha,\beta,\phi)E(r,\omega)\times R(\alpha,\beta,\phi)H^*(r,\omega), \quad \text{Eq. (24)},$$

which preserves both the amplitude and the direction of the Poynting Vector, regardless of the coordinate system r'={x', y', z'}. The Euler rotation matrix R(α, β, ϕ) can be retrieved by Procrustes analysis:

$$\|S(r,\omega)-R^{-1}(\alpha,\beta,\phi)S(r',\omega)\|_F\rightarrow\min, \quad \text{Eq. (25)},$$

subject to the constraint $S_z(r,\omega)=0$. In particular, Equation 25 enables the relative direction and orientation between the BHA and the target well to be estimated when the two are not parallel.

It also follows that the amplitudes of the total axial electric and total tangential magnetic fields in the cylindrical coordinate system r=(z, ρ, θ):

$$|E_z(r,\omega)|=\sqrt{(E^2_{x'}(r',\omega)+E^2_{y'}(r',\omega)+E^2_{z'}(r',\omega))}, \quad \text{Eq. (26), and}$$

$$|H_\theta(r,\omega)|=\sqrt{(H^2_{x'}(r',\omega)+H^2_{y'}(r',\omega)+H^2_{z'}(r',\omega))}, \quad \text{Eq. (27)}$$

are equal to the amplitude of the total electric and magnetic field vectors measured in the BHA's coordinate system r'={x', y', z'}. Accordingly, the measured electric and magnetic fields described herein, as well as the Poynting Vector calculated using the ranging method described by Equation 12, are rotationally invariant to the coordinate system of the BHA.

Figure 3F:
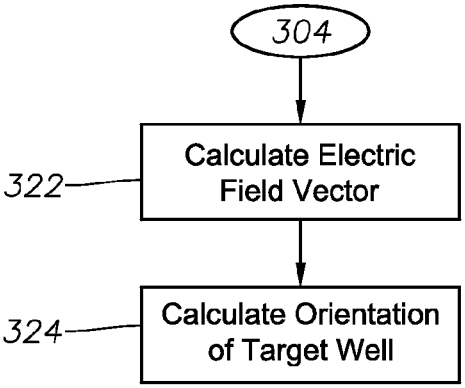
FIG. 3F is a flow chart showing how the orientation of the target well can be determined using the measured electric field, according to certain illustrative methods of the present disclosure.

FIG. 3F is a flow chart showing how the orientation of the target well can be determined using the measured electric field, according to certain illustrative methods of the present disclosure. Here, at block 322, the system control center first calculates the electric field vector using Equation 26. It is observed that the measured electric field in Equation 26 is always directed along the z-axis, which is the target well's axial direction, regardless of the orientation of the BHA. Thus, by evaluating the electric field vector from triaxial electric field measurements, the system control center can determine the orientation of the target well at block 324. This is especially useful in situations where the axis of the target well is not parallel to the BHA axis.

Although triaxial electric and magnetic field measurements have been described herein, the present disclosure may also be utilized to conduct ranging using one or two measured components of the electric and magnetic fields rather than complete triaxial measurements of the electric and magnetic fields. Thus, in certain illustrative methods, components of the electric field alone may be utilized to calculate the distance to the target well or the direction of the target well, which may be accomplished by appropriately choosing the electrode configuration such that Equation 26 is approximated with one or two measured components of the electric field, rather than all three components of the electric field.

In yet other illustrative methods, components of the magnetic field may also be used along with the non-triaxial electric field measurement to calculate the distance and direction to the target well. Again, this may be accomplished by appropriately choosing the magnetic field sensor orientations such that Equation 27 is approximated with one or two measured components of the magnetic field, rather than all three components of the magnetic field.

Although the present disclosure has focused on SAGD applications, systems and methods of the present disclosure may also be utilized in well avoidance applications. Here, a second well may be drilled, wherein the relative positioning system is used to avoid a first well. Other applications include T-intersection applications, in which a relief well must be drilled in order to relieve a blown out well. These and other applications will be apparent to those ordinarily skilled in the art having the benefit of this disclosure.

Embodiments described herein further relate to any one or more of the following paragraphs:

1. A method for downhole ranging, comprising drilling a first wellbore, the first wellbore comprising an elongated conductive body; deploying an electric field sensor in a second wellbore; inducing a current along the first wellbore that results in an electromagnetic field being emitted from the first wellbore; receiving the electromagnetic field utilizing the electric field sensor, wherein an electric field of the electromagnetic field is measured; and utilizing the measured electric field to thereby calculate: a distance between the first and second wellbores; or a direction of the first wellbore in relation to the second wellbore.

2. A method as defined in paragraph 1, wherein the direction of the first wellbore is a direction of the measured electric field.

3. A method as defined in any of paragraphs 1-2, further comprising determining an orientation of the first wellbore using the measured electric field.

4. A method as defined in any of paragraphs 1-3, further comprising calculating a gradient of the measured electric field.

5. A method as defined in any of paragraphs 1-4, further comprising calculating a ratio of the measured electric field to the gradient of the measured electric field; and calculating the distance between the first and second wellbores using the ratio.

6. A method as defined in any of paragraphs 1-5, wherein a magnetic field sensor is deployed in the second wellbore, the method further comprising measuring a magnetic field of the electromagnetic field; and utilizing the measured electric field and measured magnetic field to thereby calculate the distance between the first and second wellbores or the direction of the first wellbore in relation to the second wellbore.

7. A method as defined in any of paragraphs 1-6, further comprising utilizing the measured electric and magnetic fields to calculate a Poynting Vector; and utilizing the Poynting Vector to calculate the distance between the first and second wellbores or the direction of the first wellbore in relation to the second wellbore.

8. A method as defined in any of paragraphs 1-7, wherein the direction of the first wellbore is a direction of the Poynting Vector.

9. A method as defined in any of paragraphs 1-8, further comprising calculating a gradient of the Poynting Vector.

10. A method as defined in any of paragraphs 1-9, further comprising calculating a ratio of the Poynting Vector to the gradient of the Poynting Vector; and calculating the distance between the first and second wellbores using the ratio.

11. A method as defined in any of paragraphs 1-10, further comprising calculating an impedance of the measured electric and magnetic fields.

12. A method as defined in any of paragraphs 1-11, further comprising calculating the distance between the first and second wellbores using the impedance.

13. A method as defined in any of paragraphs 1-12, wherein calculating the distance comprises calculating a ratio of an imaginary component of the impedance at a radial frequency to a product of the radial frequency and magnetic permeability; and calculating the distance between the first and second wellbores using the ratio.

14. A method as defined in any of paragraphs 1-13, wherein the measured electric field is a triaxial electric field measurement.

15. A method as defined in any of paragraphs 1-14, wherein the measured magnetic field is a triaxial magnetic field measurement.

16. A method as defined in any of paragraphs 1-15, wherein the measured electric and magnetic fields are total electric and magnetic fields; and the measured total electric and magnetic fields are rotationally invariant.

17. A method as defined in any of paragraphs 1-16, wherein the calculated Poynting Vectors are rotationally invariant.

18. A method as defined in any of paragraphs 1-17, wherein the distance or direction calculations are conducted in real-time.

19. A method as defined in any of paragraphs 1-18, wherein the electromagnetic sensor in the second wellbore in deployed on a bottom hole assembly.

20. A method as defined in any of paragraphs 1-19, wherein the bottom hole assembly is a drilling assembly, logging assembly, or wireline assembly.

21. A method as defined in any of paragraphs 1-20, further comprising steering the bottom hole assembly deployed along the second wellbore using the distance or direction calculations.

22. A method as defined in any of paragraphs 1-20, wherein an axis of the bottom hole assembly is not parallel with an axis of the first wellbore.

23. A method as defined in any of paragraphs 1-22, wherein the first wellbore is a producer well; and the second wellbore is an injector well, wherein the method is utilized in a Steam Assisted Gravity Drainage operation.

24. A method as defined in any of paragraphs 1-23, wherein the first wellbore is a blow out well and the second wellbore is a relief well.

25. A method as defined in any of paragraphs 1-23, further comprises avoiding the first wellbore using the distance calculation.

26. A method as defined in any of paragraphs 1-25, wherein inducing the current along the first wellbore comprises inducing the current using a time-varying current source at a wellhead of the first well; a time-varying current source at a surface location; or a time-varying current source along the bottom hole assembly.

27. A relative positioning system for downhole ranging, comprising a bottom hole assembly to be positioned along a monitoring well; one or more triaxial electric and magnetic field sensors positioned along the bottom hole assembly; and processing circuitry coupled to the sensors and configured to implement a method comprising: measuring an electric field emitted from a target well; and utilizing the measured electric field to thereby calculate: a distance between the monitoring well and the target well; or a direction of the target well in relation to the monitoring well.

28. A relative positioning system as defined in paragraph 27, further comprising an electromagnetic transmitter positioned along the bottom hole assembly.

29. A relative positioning system as defined in any of paragraphs 27-28, wherein the sensors are three collocated, orthogonal magnetic coils oriented at an angle of 45 degrees relative to an axis of the bottom hole assembly; at least four electrodes positioned radially positioned around the bottom hole assembly; or at least two electrodes axially separated along the bottom hole assembly.

30. A relative positioning system as defined in any of paragraphs 27-29, wherein the bottom hole assembly is a drilling assembly, logging assembly or wireline assembly.

31. A relative positioning system as defined in any of paragraphs 27-30, wherein the processing circuitry is further configured to implement any of the methods of claims 3-17.

Moreover, the methodologies described herein may be embodied within a system comprising processing circuitry to implement any of the methods, or a in a computer-program product comprising instructions which, when executed by at least one processor, causes the processor to perform any of the methods described herein.

Accordingly, through use of the foregoing illustrative systems and methods, the distance, direction and orientation of a target well can be retrieved through rotationally invariant analysis of triaxial electric and magnetic field measurements from a BHA having electromagnetic sensors. The triaxial electric and magnetic field sensors can be deployed in any downhole device without explicitly needing to process or retrieve rotational information about the downhole BHA or wireline device. Moreover, the distance, direction and orientation of the target well can be retrieved from a single measurement position.

The advantages of the present disclosure are numerous. For example, such advantages include: direct measurement of the electric field and/or electric field gradients generated by the target well using triaxial electric field sensors; the direction of the measured electric field retrieves the orientation of the target well; the direction of the target well is retrieved from the measured electric field and electric field gradient; direct measurement of the Poynting Vector and/or Poynting Vector gradients of electromagnetic fields generated by the target well using triaxial electric and magnetic field sensors; the direction of the Poynting Vector retrieves the direction to and orientation of the target well; direct measurement of the impedance transfer function of electromagnetic fields generated by the target well using triaxial electric and magnetic field sensors; the impedance transfer function retrieves the distance to the target well; rotational invariance of the electric fields, electric field gradients, Poynting Vector, Poynting Vector gradient, and the impedance transfer function relative to sensor orientation; and real-time integration with drilling systems.

Although various embodiments and methodologies have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A method for downhole ranging, comprising:

drilling a first wellbore, the first wellbore comprising an elongated conductive body;

deploying an electric field sensor in a second wellbore;

inducing a current along the first wellbore that results in an electromagnetic field being emitted from the first wellbore;

receiving the electromagnetic field utilizing the electric field sensor, wherein an electric field of the electromagnetic field is measured; and utilizing the measured electric field to thereby calculate:

an orientation of the first wellbore; and a distance between the first and second wellbores; or a direction of the first wellbore in relation to the second wellbore.

2. The method as defined in claim 1, wherein the direction of the first wellbore is a direction of the measured electric field.

3. The method as defined in claim 1, further comprising calculating a gradient of the measured electric field.

4. The method as defined in claim 3, further comprising:

calculating a ratio of the measured electric field to the gradient of the measured electric field; and calculating the distance between the first and second wellbores using the ratio.

5. The method as defined in claim 1, wherein a magnetic field sensor is also deployed in the second wellbore, the method further comprising:

measuring a magnetic field of the electromagnetic field; and utilizing the measured electric field and measured magnetic field to thereby calculate:

the distance between the first and second wellbores; or the direction of the first wellbore in relation to the second wellbore.

6. The method as defined in claim 5, further comprising:

utilizing the measured electric and magnetic fields to calculate a Poynting Vector; and utilizing the Poynting Vector to calculate:

the distance between the first and second wellbores; or the direction of the first wellbore in relation to the second wellbore.

7. The method as defined in claim 6, wherein the direction of the first wellbore is a direction of the Poynting Vector.

8. The method as defined in claim 6, further comprising calculating a gradient of the Poynting Vector.

9. The method as defined in claim 8, further comprising:

calculating a ratio of the Poynting Vector to the gradient of the Poynting Vector; and calculating the distance between the first and second wellbores using the ratio.

10. The method as defined in claim 5, further comprising calculating an impedance of the measured electric and magnetic fields.

11. The method as defined in claim 10, further comprising calculating the distance between the first and second wellbores using the impedance.

12. The method as defined in claim 11, wherein calculating the distance comprises:

calculating a ratio of an imaginary component of the impedance at a radial frequency to a product of the radial frequency and magnetic permeability; and calculating the distance between the first and second wellbores using the ratio.

13. The method as defined in claim 5, wherein the measured magnetic field is a triaxial magnetic field measurement.

14. The method as defined in claim 5, wherein:

the measured electric and magnetic fields are total electric and magnetic fields; and the measured total electric and magnetic fields are rotationally invariant.

15. The method as defined in claim 6, wherein the calculated Poynting Vectors are rotationally invariant.

16. The method as defined in claim 1, wherein the measured electric field is a triaxial electric field measurement.

17. The method as defined in claim 1, wherein the distance or direction calculations are conducted in real-time.

18. The method as defined in claim 1, wherein the electric field sensor in the second wellbore in deployed on a bottom hole assembly.

19. The method as defined in claim 18, wherein the bottom hole assembly is a drilling assembly, logging assembly, or wireline assembly.

20. The method as defined in claim 18, further comprising steering the bottom hole assembly deployed along the second wellbore using the distance or direction calculations.

21. The method as defined in claim 18, wherein an axis of the bottom hole assembly is not parallel with an axis of the first wellbore.

22. The method as defined in claim 18, wherein inducing the current along the first wellbore comprises inducing the current using:

a time-varying current source at a wellhead of the first well;

a time-varying current source at a surface location; or a time-varying current source along the bottom hole assembly.

23. The method as defined in claim 1, wherein:

the first wellbore is a producer well; and the second wellbore is an injector well, wherein the method is utilized in a Steam Assisted Gravity Drainage operation.

24. The method as defined in claim 1, wherein:

the first wellbore is a blow out well; and the second wellbore is a relief well.

25. The method as defined in claim 1, further comprises avoiding the first wellbore using the distance calculation.

26. A relative positioning system for downhole ranging, comprising:

a bottom hole assembly to be positioned along a monitoring well;

one or more triaxial electric and magnetic field sensors positioned along the bottom hole assembly; and processing circuitry coupled to the sensors and configured to implement a method comprising:

measuring an electric field emitted from a target well; and utilizing the measured electric field to thereby calculate:

an orientation of the first wellbore; and a distance between the monitoring well and the target well; or a direction of the target well in relation to the monitoring well.

27. The relative positioning system as defined in claim 26, further comprising an electromagnetic transmitter positioned along the bottom hole assembly.

28. The relative positioning system as defined in claim 26, wherein the sensors are:

three collocated, orthogonal magnetic coils oriented at an angle of 45 degrees relative to an axis of the bottom hole assembly;

at least four electrodes positioned radially positioned around the bottom hole assembly; or at least two electrodes axially separated along the bottom hole assembly.

29. The relative positioning system as defined in claim 26, wherein the bottom hole assembly is a drilling assembly, logging assembly or wireline assembly.

30. The relative positioning system as defined in claim 26, wherein the processing circuitry is further configured to implement any of the methods of claims 3-15.

* * * * *